US008373532B2

(12) United States Patent
Kikuchi et al.

(10) Patent No.: US 8,373,532 B2
(45) Date of Patent: Feb. 12, 2013

(54) COIL

(75) Inventors: Shuichi Kikuchi, Tokyo (JP); Fumihito Meguro, Tokyo (JP); Yoshiyuki Hatayama, Tokyo (JP)

(73) Assignee: Sumida Corporation, Tokyo (JP)

( * ) Notice: Subject to any disclaimer, the term of this patent is extended or adjusted under 35 U.S.C. 154(b) by 2 days.

(21) Appl. No.: 12/882,480

(22) Filed: Sep. 15, 2010

(65) Prior Publication Data

US 2011/0090035 A1 Apr. 21, 2011

(30) Foreign Application Priority Data

Oct. 16, 2009 (JP) ..... 2009-239738
Aug. 18, 2010 (JP) ..... 2010-182794

(51) Int. Cl.
*H01F 27/28* (2006.01)
*H01F 27/30* (2006.01)

(52) U.S. Cl. ..... 336/189; 336/188; 336/184; 336/206

(58) Field of Classification Search ..... 336/189
See application file for complete search history.

(56) References Cited

U.S. PATENT DOCUMENTS 512,340 A * 1/1894 Tesla ..... 336/222
3,676,814 A * 7/1972 Trunzo et al. ..... 336/205
4,926,111 A * 5/1990 Lungu ..... 323/355
7,714,687 B2 * 5/2010 Marui et al. ..... 336/198
7,830,237 B1 * 11/2010 Chen ..... 336/220
8,207,807 B2 * 6/2012 Kikuchi et al. ..... 336/188
2008/0186121 A1 * 8/2008 Kawahata et al. ..... 336/182

FOREIGN PATENT DOCUMENTS

JP A-2002-170729 6/2002
JP A-2006-49750 2/2006
JP A-2007-324532 12/2007

* cited by examiner

*Primary Examiner* — Mohamad Musleh
*Assistant Examiner* — Ronald Hinson
(74) *Attorney, Agent, or Firm* — Oliff & Berridge, PLC

(57) ABSTRACT

In the winding wire at the winding completion end side, two wires are piled up vertically and wound together from the inner circumferential side towards the outer circumferential side. The winding wire at the winding start end side that has remained on the inner circumferential side is drawn forth from the inner circumferential side to the outer circumferential side so as to form a curve along the flat surface of the coil. In the crossing portions of the winding wire at the winding completion end side and the winding wire at the winding start end side, the two wires of each winding wire are superimposed and caused to cross each other in a state in which the wires are laid down transversely.

9 Claims, 7 Drawing Sheets

COIL

RELATED APPLICATIONS

This application claims the priority of Japanese Patent Application No. 2009-239738 filed on Oct. 16, 2009 and No. 2010-182794 filed on Aug. 18, 2010, which are incorporated herein by reference.

BACKGROUND OF THE INVENTION

1. Field of the Invention

The present invention relates to an advantageous coil as a thin-type coil for use in an electric device, and more particularly to a coil in which either of a first end of wire and a second end of wire is wound from an inner circumferential side towards an outer circumferential side, whereas the other end of wire is drawn forth from the inner circumferential side to the outer circumferential side.

2. Description of the Prior Art

An α winding method is generally known as a method for winding a coil by which a first end of wire and a second end of wire are both wound around from the inner circumferential side towards the outer circumferential side. With this winding method, as indicated in Japanese Patent Application Laid-open No. 2002-170729, a winding shaft is set close to the center at both ends of the wires and the first end of the wire and the second end of the wire are wound in mutually opposite directions, whereby a coil can be formed in which both the first end of the wire and the second end of the wire are drawn forth to the outside.

A method is also known by which a winding start end side of a coil is fixed, the winding completion end side is wound from the inner circumferential side towards the outer circumferential side and the winding start end is drawn forth from the inner circumferential side towards the outer circumferential side. In this case, the winding start end is dragged over the flat surface of the wound coil, and the draw-forth line portion of the winding start end side becomes larger in size (thickness) in the height direction by the diameter of the winding wire at the winding start end. A known measure for resolving this problem is to provide a concavity on the flat surface of the wound coil along the draw-forth line of the winding start end on the flat surface of the wound coil (see Japanese Patent Application Laid-open No. 2006-049750).

However, the problem related to the coil described in Japanese Patent Application Laid-open No. 2002-170729 is that because the first end of the wire and the second end of the wire are wound in the mutually opposite directions and the winding wires are piled up in two layers at the crossing portions thereof, a portion with a height twice the diameter of the wires appears along the crossing portions. Further, when the coil is an air-core coil, problems are related to the coil strength because of the structure in which the winding wires are piled up in two layers.

Further, with the α winding method described in Japanese Patent Application Laid-open No. 2002-170729, where winding is wound in a state in which the length of the first end of the wire portion is substantially equal to that of the second end of the wire portion, when the coil with a large number of turns (a large length of winding wires) is wound, fliers 11*a*, 11*b*, which are on the side where rotation is caused, have to be large and the size of the winding apparatus itself becomes large.

In the case of the coil described in Japanese Patent Application Laid-open No. 2006-049750, since the flat surface of the wound coil is concaved along the draw-forth line of the winding start end side from the inner circumferential side towards the outer circumferential side, stresses are applied to the flat surface of the coil and the coating on the winding wire can be damaged or the winding wire can be broken. Further, due to concavity on the flat surface of the wound coil, there may be a problem that the winding wire protrudes at other portions.

SUMMARY OF THE INVENTION

The present invention has been created to resolve the above-described problems and it is an object thereof to provide a coil in which one of a first end of wire and a second end of wire is wound from an inner circumferential side towards an outer circumferential side, and the other one of the first end of the wire and the second end of the wire is drawn forth from the inner circumferential side to the outer circumferential side, wherein a significant increase in a winding height at crossing portions of the first end of the wire and the second end of the wire compared to a winding height in other portions is prevented and the coil can be easily manufactured.

The coil in accordance with the present invention has the following features that make it possible to attain the above-described object.

Thus, the coil in accordance with the present invention comprises first ends and second ends of winding wire which is formed by a plurality of wires, where one of the first ends and the second ends of the winding wire are wound from an inner circumferential side towards an outer circumferential side and the other of the first ends and the second ends of the winding wire is drawn from the inner circumferential side towards the outer circumferential side, wherein the plurality of wires are wound together in a state of being piled up in a vertical direction, and the plurality of wires are superimposed and caused to cross each other in a state in which the plurality of wires are laid down transversely at crossing portions of the first ends of the wires and the second ends of the wires.

It is preferred that the first ends of the wires are wound from the inner circumferential side towards the outer circumferential side, the second ends of the wires are drawn forth to the outer circumferential side so as to form a curve, and the crossing portions are arranged so as to be displaced in the circumferential direction towards the outer circumference. It is also preferred that in this case the second ends of the wires are drawn by winding of an integer number of turns from the inner circumferential side towards the outer circumferential side to form a curve on a coil flat surface and then drawn forth to the outer circumferential side. Further, in accordance with the present invention, the plurality of wires may be constituted by self-fusing wires. The coil in accordance with the present invention may be an air-core coil. Still further, an outer contour shape and a shape of each corner of the air-core portion may be either of rounded rectangular shape or elliptical shape. In addition, the coil in accordance with the present invention is constituted for using in contactless power transmission.

A plurality of wires that can be separated from one another at the winding stage and integrally fixed to each other by processing such as fusion after the winding is completed, and also wires (including twisted wires) that have already been integrated at the winding stage, and wires that are mutually lightly twisted at the winding stage can be used as the aforementioned "plurality of wires".

The aforementioned "state in which the plurality of wires are piled up in a vertical direction" and "state in which the plurality of wires are laid down transversely" mean that the arrangement of the plurality of wires in the latter state is longer in the transverse direction than that in the former state.

A mode of transition from "the state in which the plurality of wires are piled up in a vertical direction" to "the state in which the plurality of wires are laid down transversely" is a mode in which an arrangement state of the plurality of wires is changed to an arrangement state in which the plurality of wires are entirely twisted through 90 degrees, without changing the relative positional relationship of the plurality of wires (referred to hereinbelow as "twisting mode") or a mode in which the relative positional relationship of the plurality of wires is allowed to change and the arrangement state of the plurality of wires is crushed in the vertical direction to obtain a flat configuration in the transverse direction (referred to hereinbelow as "crushing mode"). The twisting mode is effective when the plurality of wires have already been integrally fixed at the winding stage, and the crushing mode is effective when the plurality of wires can be separated from one another at the winding stage.

With the coil in accordance with the present invention in which a plurality of wires being piled up vertically are wound together, the plurality of wires are superimposed and caused to cross each other in a state in which the plurality of wires are laid down transversely. Therefore, the height at the crossing portions can be greatly reduced with respect to that in the related art and made equal to that in other regions.

Further, when the plurality of wires are wound together, it has effect in a skin effect. Yet another advantage is that the coil can be easily wound, without using a winding apparatus of larger size, as in the case in which the a winding method is used.

DESCRIPTION OF THE PREFERRED EMBODIMENTS

An embodiment of the coil in accordance with the present invention will be described below with reference to FIGS. 1 to 5 and FIG. 12.

Figure 12:
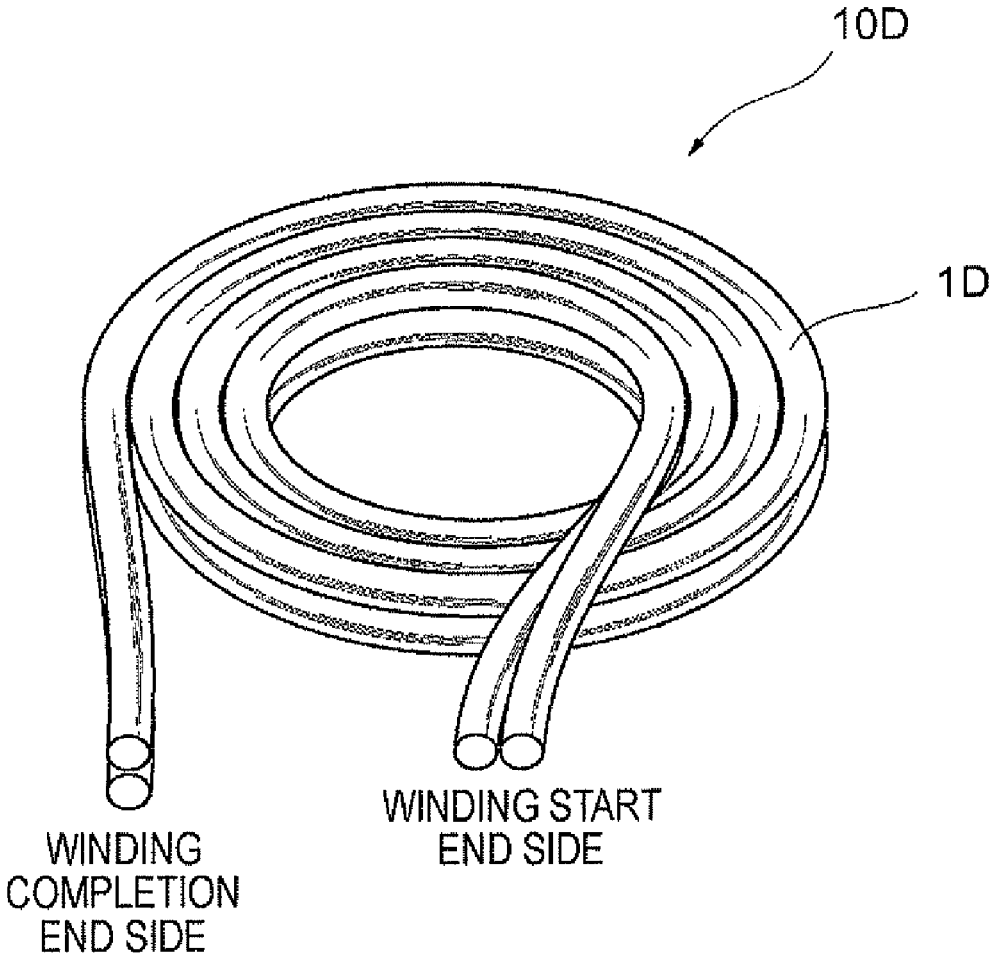
FIG. 12 is a schematic perspective view illustrating the general external appearance of a coil that is a prototype of the coil in accordance with the present invention.

FIG. 1 shows a coil 10 of the present embodiment, and a basic shape serving as a prototype thereof is shown in FIG. 12. FIG. 1 illustrates a case in which only four below-described crossing portions are provided for purpose of convenience of explanation. Further, the word "wire" is used in an explanation of the present invention. The "wire" means one line-shaped material provided with an insulated film on a surface of conductor which has conductivity such as copper, silver, etc.

Thus, a coil 10D shown in FIG. 12 is a flat air-core monolayer spirally wound coil (for example, disclosed in Japanese Patent Application Laid-open No. 2007-324532). In this coil, two winding wires having a diameter about half that of the winding wire that has been usually used are piled up vertically. At the winding completion end side, the two winding wires are wound together from the inner circumferential side towards the outer circumferential side, whereas at the winding start end side remaining at the inner circumferential side, the winding wire is drawn forth from the inner circumferential side towards the outer circumferential side along the flat surface of the coil 10D. In the case in which one winding wire of a typical diameter is wound and in the case in which two winding wires, each having half the diameter of the one winding wire, are piled up vertically and wound, as shown in FIG. 12, the height can be made practically unchanged.

However, when a winding wire 1D at the winding start end side is drawn forth from the inner circumferential side to the outer circumferential side along the flat surface (upper flat surface, same hereinbelow) of the coil 10D, as shown in FIG. 12, the portion along the winding wire 1D at the winding start end side becomes higher than other portions of the coil flat surface, the structural strength of the coil decreases and the coil is difficult to reduce in thickness.

Accordingly, the configuration of the coil of the present embodiment is such that at the crossing portions of the winding wire 1 at the winding completion end side and the winding wire 1 at the winding start end side, the winding wires 1 (more specifically, two wires constituting the winding wire 1) are superimposed and caused to cross each other in a state in which the winding wires are laid down transversely.

Figure 1A:
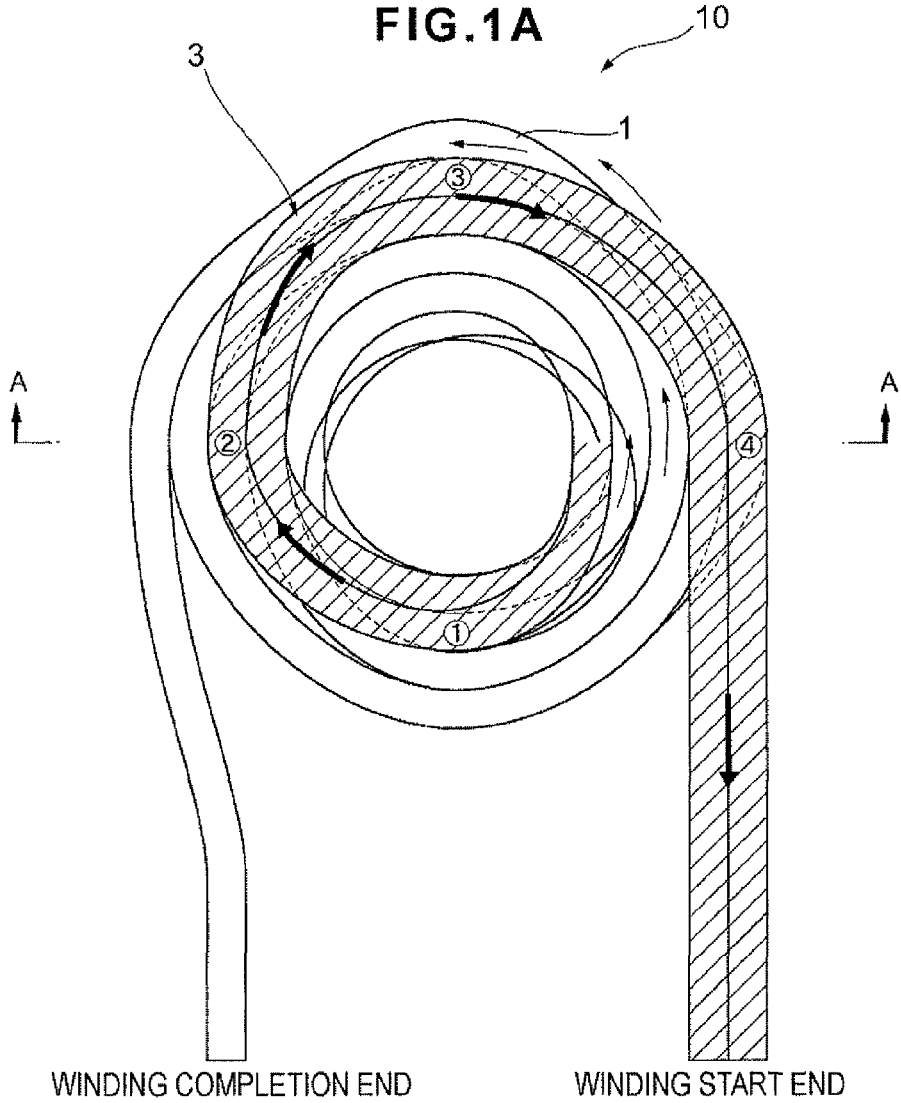
FIGS. 1A to 1C are schematic views illustrating the configuration of a coil of an embodiment of the present invention.

Thus, in FIG. 1A, when the winding wire 1 at the winding start end side is drawn forth from the inner peripheral side towards the outer peripheral side, the winding wire 1 is drawn forth, while being wound one turn clockwise. In each position in which the winding wire 1 at the winding start end side is wound through 90 degrees (positions 1, 2, 3, and 4 in FIG. 1A (in the figure, these numerals are enclosed in circles)), this winding wire 1 crosses the winding wire 1 of the next turn on the winding completion end side. Therefore, in this portion, the two wires that have been piled up vertically in the winding wire 1 at the winding completion end side are laid down transversely (twisting mode), and the winding wire 1 at the winding start end side that has been drawn forth from the inner peripheral side towards the outer peripheral side in a state in which the two wires were originally laid down transversely is superimposed on the aforementioned winding wire 1 and caused to cross it.

Figure 1B:
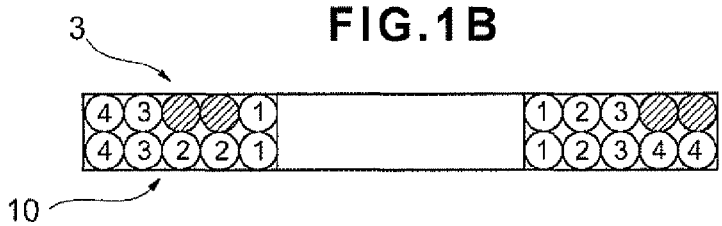
Figure 1C:
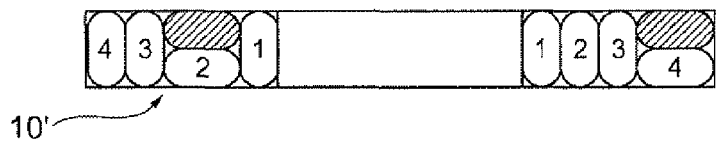

Thus, in the position 1 in FIG. 1A, the winding wire 1 of the first turn at the winding completion end side and the winding wire 1 at the winding start end side (hatched winding wire) cross each other. In the position 2 in FIG. 1A, the winding wire 1 of the second turn at the winding completion end side and the winding wire 1 at the winding start end side cross each other. In the position 3 in FIG. 1A, the winding wire 1 of the third turn at the winding completion end side and the winding wire 1 at the winding start end side cross each other. In the position 4 in FIG. 1A, the winding wire 1 of the fourth turn at the winding completion end side and the winding wire 1 at the winding start end side cross each other. In these positions 1, 2, 3, and 4 in FIG. 1A, the two wires of the winding wire 1 at the winding completion end side are laid down transversely, as shown in FIGS. 1A and 1B. Therefore, this winding wire 1 at the winding completion end side is disposed only in the lower layer and the two wires of the winding wire 1 at the winding start end side (see hatched cross section of the winding wire in FIG. 1B) are superimposed on the vacant upper layer thereof. As a total, the height can be adjusted to that in the other regions even at the crossing portion, and the problem of the total height increasing by the height of the drawn-forth wire, which is inherent to the conventional technology, can be resolved.

Figure 2:
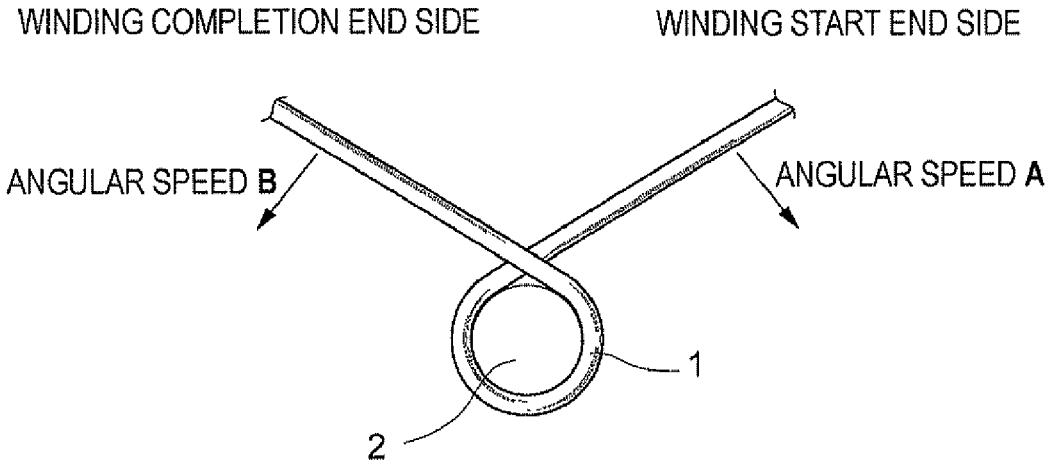
FIG. 2 is a schematic view for explaining the formation sequence of the coil of the present embodiment.
Figure 3:
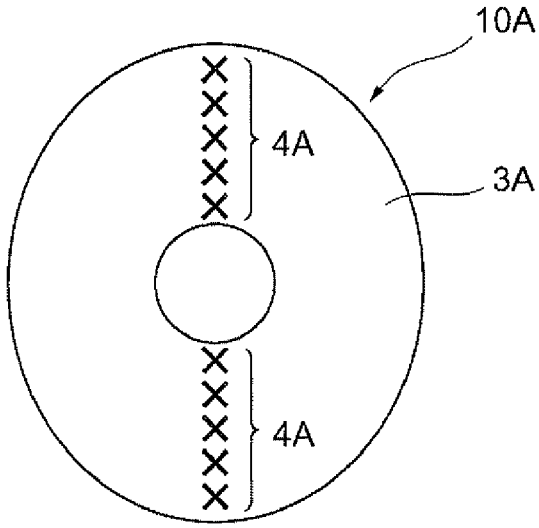
FIG. 3 is a schematic view for explaining a case in which crossing portions are arranged in the radial direction of a coil flat surface.

However, because of a state in which the two wires are laid down transversely at the crossing portion, the winding shape at the winding completion end side in this portion protrudes by one wire to the outer circumferential side. Therefore, where the winding wire 1 at the winding start end side and the winding wire 1 at the winding completion end side are wound simultaneously at the same winding speed in the mutually opposite directions around the winding shaft 2, for example, as shown in FIG. 2, the crossing portions 4A thereof will be arranged along a straight line in the radial direction, as shown in FIG. 3. As a result, a flat surface 3A of a coil 10A will have an elliptical shape.

Figure 4:
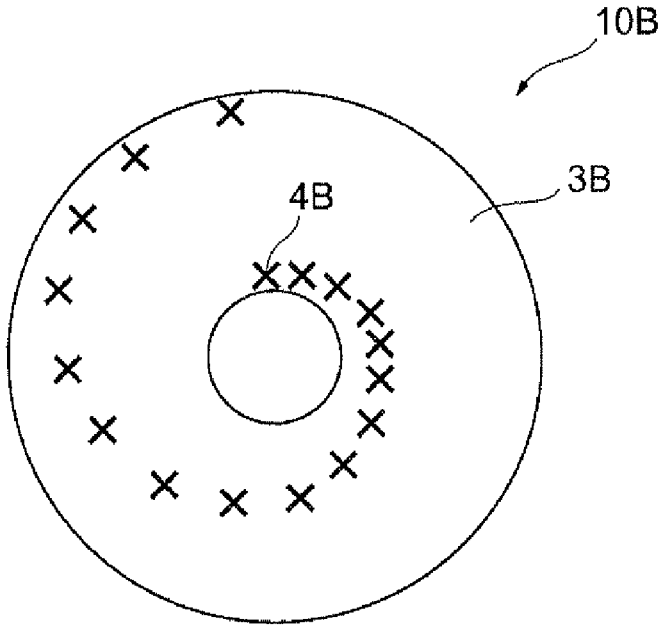
FIG. 4 is a schematic view for explaining a case in which crossing portions are arranged spirally in the coil flat surface.

A variety of inconveniences are encountered when the flat surface 3A of the coil 10A has an elliptical shape. Therefore, it is preferred that the crossing portions 4A are prevented from being arranged in a single row in the radial direction. For example, where crossing portions 4B are arranged so as to form a spiral from the inner circumferential side towards the outer circumferential side as shown in FIG. 4, the linear arrangement in the radial direction is prevented, and a flat surface 3B of a coil 10B has a shape close to a real circle.

A method for winding of the winding wire 1, as the crossing portions 413 is spirally formed on the flat surface 3B of the coil 10B, includes, for example, as shown in FIG. 2, winding the winding wire 1 at the winding start end side and the winding wire 1 at the winding completion end side around the winding shaft 2 so that the angular speed A of the winding wire 1 of the former and the angular speed B of the winding wire 1 of the latter differ from each other, and gradually displacing the crossing position in the circumferential direction towards the outer circumferential side. As a result, the difference between the angular speeds A and B will create a difference between the number of turns of the winding wire 1 at the winding start end side and the number of turns of the winding wire 1 at the winding completion end side and therefore the winding angles of the two winding wires 1 from one crossing portion to the next crossing portion will differ from each other. As a consequence, the flat surface 3A of the coil 10A can be prevented from becoming an elliptical shape, as shown in FIG. 3.

It is even more desirable that the coil flat surface is formed closer to a real circular shape by setting the number of turns at the winding start end side to an integer number (the start point of winding of the winding wire 1 at the winding start end side is in the position of the crossing portion 4B with the winding wire 1 at the winding completion end side that is on the innermost peripheral side).

In the above-described embodiment shown in FIG. 1, the crossing portions 4 are assumed to appear for every 90 degrees, for purpose of convenience of explanation, but actually by setting the winding to a larger difference between the number of turns of the winding wire 1 at the winding start end side and the number of turns of the winding wire 1 at the winding completion end side, it is possible to create the crossing portions with a smaller angular spacing and carry across the winding wire 1 at the winding start end side so as to follow the crossing portions 4, thereby making it possible to adjust the height of the winding wire 1 at the winding start end side over almost the entire draw-forth region to that in the other regions.

For example, when the winding wires are wound in the mutually opposite directions with a specification such that the number of turns of the winding wire 1 at the winding completion end side is 15 and the number of turns of the winding wire 1 at the winding start end side is 1, the crossing portions 4B of the winding wire 1 at the winding completion end side and the winding wire 1 at the winding start end side will be present for each single turn of the winding wire 1 at the winding completion end side and a total of 15 crossing portions will be present. Therefore, each time the winding wire 1 at the winding completion end side is wound through (360°-360°/15=360°-24°=) 336°, the two wires piled up vertically will be twisted by 90 degrees and crossing portions 4 that are laid down transversely will be formed. Where the winding wire 1 at the winding start end side is laid down along one circumference, following this crossing portion 4, the height of the winding wire 1 at the winding start end side over almost the entire draw-forth region can be adjusted to that in other regions and the coil 10 of a substantially real circular shape can be formed.

Further, when the coil 10 is manufactured, the coil can be formed, as described hereinabove, by winding clockwise either of the winding wire 1 at the winding completion end side and the winding wire 1 at the winding start end side and winding counterclockwise the other of the two, the two winding wires being wound at mutually different angular speeds. Further, a winding method may be used by which the winding wire 1 at the winding completion end side is wound through 360°-24°, the winding operation is then temporarily stopped, the winding wire 1 at the winding start end side is dragged to the crossing portion 4, the winding wire 1 at the winding completion end side is again wound through 360°-24°, the winding operation is then temporarily stopped, and the winding wire 1 at the winding start end side is dragged to the next crossing portion 4.

Further, the entire processing (crossing portion creation processing) by which a winding wire arrangement in which the two wires are piled up vertically is temporarily changed to that in which the wires are laid down transversely may be performed at the very beginning when the winding wire 1 at the winding completion end side is wound with respect to the locations where the winding start is disposed in the completed product, and then the winding wire 1 at the winding start end may be laid down along the concave positions (crossing portions) that are laid down transversely, when the coil flat surface 3 is viewed from above.

An embodiment of the present invention is described above, but the present invention is not limited to the above-described embodiment, and the number of wires that are wound together or the total number of crossing portions can be changed appropriately.

For example, in the above-described embodiment, a mode is explained in which two wires are wound together, but three, four, or more wires may be also bundled and wound together.

Further a case is explained in which the number of turns at the winding completion end side is 15 and the number of turns at the winding start end side is 1, but these numbers are not limiting, and any number N of turns at the winding completion end side can be selected. When the number of turns at the winding start end side is 1, a crossing portion may be present for each 360°-360°/N range.

Further, in the above-described embodiment, a case is explained in which winding wires (wires) are round, but such a shape is not limiting and rectangular wires or angular wires may be also wound. In this case, a cross section in the form of a rectangle with a 2:1 ratio is preferred.

In this case, the wiring wire 1 at the winding completion end side is wound with a longer side in the vertical direction, the winding wire 1 is toppled in the crossing portion so that the longer side is oriented in the horizontal direction, and the winding wire 1 at the winding start end side that has been arranged to have the longer side in the horizontal direction is laid down on top thereof. As a result, the height in the crossing portion can be adjusted to that in other portions, and similarly to the above-described embodiment, the problem of the height as a total being increased by the height of the drawn-forth wire can be resolved (see FIG. 1C; the number in the wiring wire in the figure represents the number of winding turns; the reference number 3' represents a flat surface of the coil and 10' represents the coil).

Figure 5:
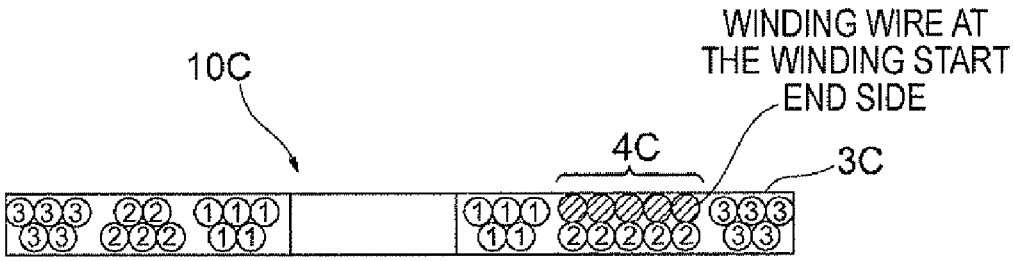
FIG. 5 is a schematic view for explaining a case in which the number of wires that are wound simultaneously is 5 in the configuration in accordance with the present invention.

FIG. 5 shows a schematic cross-section of a coil 10C in a case in which five wires are wound together. Thus, in the first-turn and third-turn winding from the inner circumferential side of the wiring wire 1 at the winding completion end side, there are two lower layers and three upper layers, whereas in the second-turn winding, the arrangement of five wires in the crossing portion 4C is crushed in the vertical direction and flattened in the transverse direction, thereby spreading the lower layer into five wires (crushing mode). The wires of the winding wire 1 at the wiring start end side (see hatched cross sections of winding wires in FIG. 5) are laid down on top of the lower layer in the vacant upper layer as a row consisting of five wires. The total height in the crossing portion 4C is thus adjusted to that in other regions.

However, in a mode in which these five wires are wound together, because the wires that have been piled up vertically are spread transversely as a single row in the crossing portion 4C, the completely twisted wire cannot be obtained, but light twisting as a whole may be provided. In FIG. 5, large gaps are provided between some wires so that the arrangement state of the five wires can be easily seen. However, such large gaps are actually not present between the wires and the wires are wound tightly.

Figure 6A:
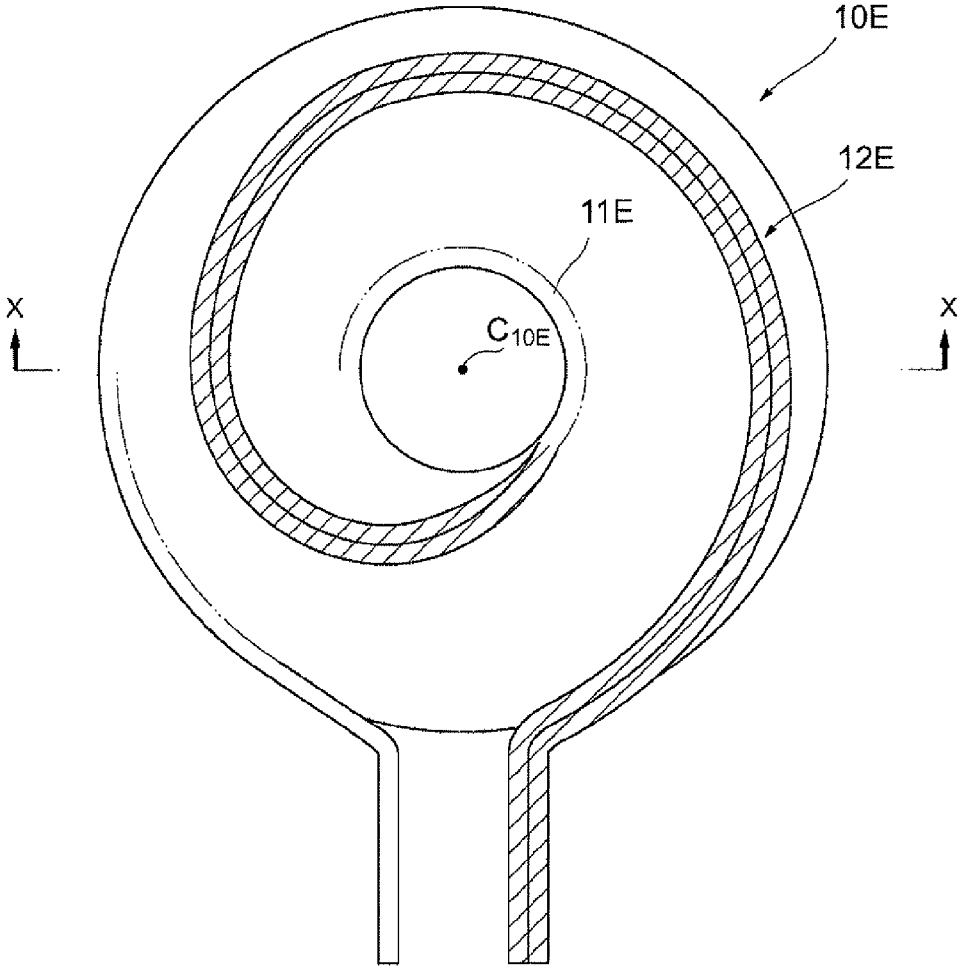
FIGS. 6A and 6B are schematic views for explaining another mode of a case in which the number of wires that are wound simultaneously is 2 in the configuration in accordance with the present invention.
Figure 6B:
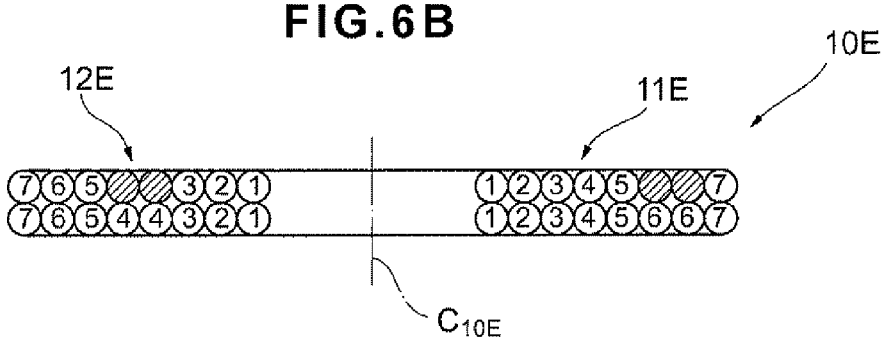

FIG. 6 shows schematically a coil 10E in which two wires are wound together in the same manner as in the above-descried coil 10 (FIG. 6A is a plan view, FIG. 6B is a cross-sectional view taken along the X-X line in FIG. 6A). In FIG. 6B, the numerical values introduced in the cross section represent the number of winding turns in the winding wires (the same is in FIGS. 7 to 9 below).

In the coil 10E shown in FIG. 6, a winding wire is constituted by two wires. A winding wire 11E at the wiring completion end side (only the innermost circumferential portion is numbered in FIG. 6A) is tightly wound (about 7 turns) counterclockwise from the inner circumference to the outer circumference. A winding wire 12E at the winding start end side (hatched winding wire) is drawn forth from the inner circumference to the outer circumference, while crossing the winding wire 11E at the wiring completion end side and being wound (about 1 turn) clockwise so as to form a smooth spiral curve. In this configuration, the thickness in the vertical direction (direction of the winding shaft axis $C_{10E}$) in the crossing portion of the winding wire 11E at the wiring completion end side and the winding wire 12E at the winding start end side is equal to that in other portions.

Thus, as shown in FIG. 6B, the winding wire 12E at the winding start end side (hatched winding wire) is wound in a state in which two wires are arranged side by side in the transverse direction (radial direction), whereas the winding wire 11E at the wiring completion end side (winding wire in which a digit is inserted into a circle) is wound in a state in which the two wires are piled up vertically in portions where the winding wire 12E at the winding start end side is not crossed and wound in a state in which the two wires are laid down transversely in portions where the winding wire 12E at the winding start end side is crossed (when the arrangement state of the wires of the winding wire 11E at the wiring completion end side is changed, since the number of the wires is as small as two, both the crushing mode and the twisting mode can be realized). As a result, the thickness in the vertical direction in the crossing portions of the winding wire 11E at the wiring completion end side and the winding wire 12E at the winding start end side is made equal to that in other portions.

Figure 7:
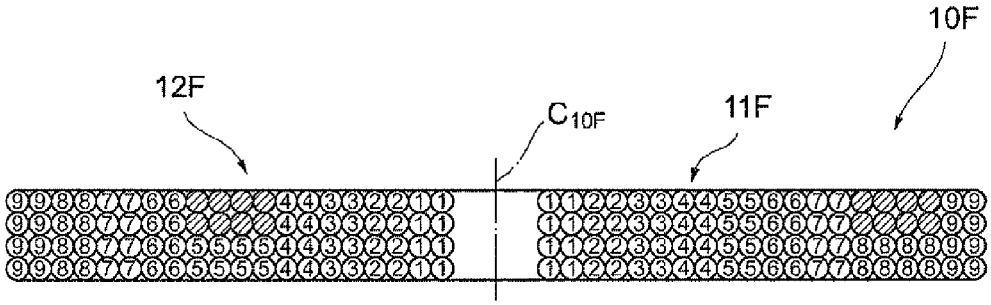
FIG. 7 is a schematic view for explaining a case in which the number of wires that are wound simultaneously is 8 in the configuration in accordance with the present invention.

FIG. 7 shows a cross section of a coil 10F constituted by winding wires composed of eight wires. In the coil 10F, a winding wire 12F at the winding start end side is normally wound in a state in which the eight wires are arranged in four rows in the transverse direction (radial direction) and arranged in two rows in the vertical direction (direction of the winding shaft axis $C_{10F}$), whereas a winding wire 11F at the winding completion end side is wound in a state in which the eight wires are piled up vertically and arranged in two rows in the transverse direction and in four rows in the vertical direction in portions where the winding wire 12F at the winding start end side is not crossed and wound in a state in which the eight wires are laid down transversely and arranged in four rows in the transverse direction and in two rows in the vertical direction in portions where the winding wire 12F at the winding start end side is crossed (when the arrangement state of the wires of the winding wire 11F at the winding completion end side is changed, since the number of the wires is as large as eight, the crushing mode is preferred). The configuration obtained in this case is also such that the thickness in the vertical direction in the crossing portions of the winding wire 11F at the winding completion end side and the winding wire 12F at the winding start end side is equal to that in other portions.

Figure 8:
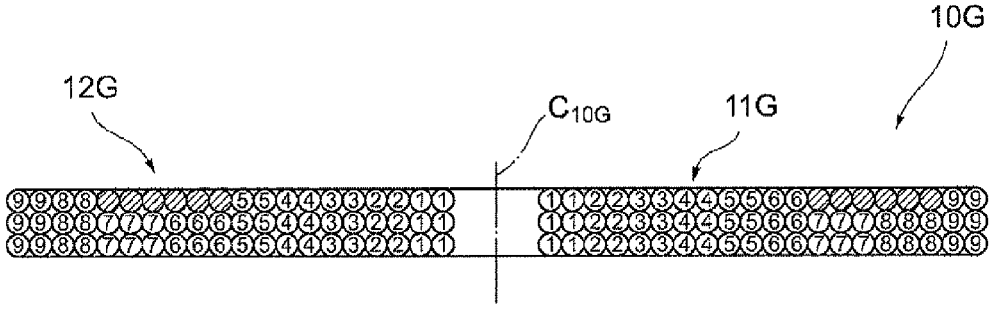
FIG. 8 is a schematic view for explaining a case in which the number of wires that are wound simultaneously is 6 in the configuration in accordance with the present invention.

FIG. 8 shows a cross section of a coil 10G constituted by winding wires composed of six wires. In the coil 10G, a winding wire 12G at the winding start end side is normally wound in a state in which the six wires are arranged in six rows in the transverse direction (radial direction) and arranged in one row in the vertical direction (direction of the winding shaft axis $C_{10G}$), whereas a winding wire 11G at the winding completion end side is wound in a state in which the six wires are piled up vertically and arranged in two rows in the transverse direction and in three rows in the vertical direction in portions where the winding wire 12G at the winding start end side is not crossed and wound in a state in which the six wires are laid down transversely and arranged in three rows in the transverse direction and in two rows in the vertical direction in portions where the winding wire 12G at the winding start end side is crossed (when the arrangement state of the wires of the winding wire 11G at the winding completion end side is changed, since the number of the wires is as large as six, the crushing mode is preferred). The configuration obtained in this case is also such that the thickness in the vertical direction in the crossing portions of the winding wire 11G at the winding completion end side and the winding wire 12G at the winding start end side is equal to that in other portions.

Figure 9:
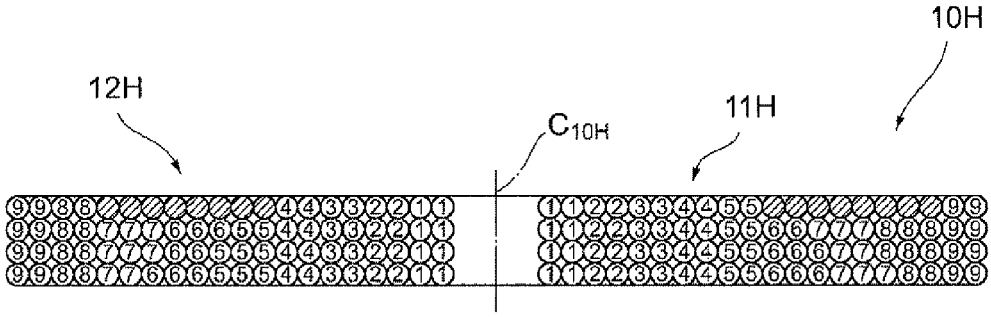
FIG. 9 is a schematic view for explaining another mode of a case in which the number of wires that are wound simultaneously is 8 in the configuration in accordance with the present invention.

FIG. 9 shows a cross section of a coil 10H constituted by winding wires composed of eight wires. In the coil 10H, a winding wire 12H at the winding start end side is normally wound in a state in which the eight wires are arranged in eight rows in the transverse direction (radial direction) and arranged in one row in the vertical direction (direction of the winding shaft axis $C_{10H}$), whereas a winding wire 11H at the winding completion end side is wound in a state in which the eight wires are piled up vertically and arranged in two rows in the transverse direction and in four rows in the vertical direction in portions where the winding wire 12H at the winding start end side is not crossed and wound in a state in which the arrangement state of the eight wires is crushed in the vertical direction and flattened in the transverse direction (an arrangement state with three rows in the vertical direction and three rows or two rows in the transverse direction), so that the eight wires of the winding wire 12H at the winding start end side fill successively the spaces formed at the lower side in the figure in the eight wires of the winding wire 12H at the winding start end side (crushing mode). The configuration obtained in this case is also such that the thickness in the vertical direction in the crossing portions of the winding wire 11H at the winding completion end side and the winding wire 12H at the winding start end side is equal to that in other portions.

An air-core coil in a wound state obtained with the crushing mode is formed by the following winding method. Thus, as shown in FIG. 2, a winding wire at the winding start end side and a winding wire at the winding completion end side in which each wire is constituted by the so-called self-fusing wire (for example, a copper wire coated with polyurethane that is further coated on the outer side with a thermoplastic fusible varnish or the like) and can be separated from each other are wound in the mutually opposite directions around a winding shaft 2 of a winding apparatus. In this case, the winding is wound by setting mutually different angular speed A of the winding wire at the winding start end side and angular speed B of the winding wire at the winding completion end side, while controlling the thickness in the winding shaft direction (direction perpendicular to the paper sheet) to the thickness of a predetermined number of wires (in the case of the coil 10E, the thickness of two wires; in the case of the coils 10F and 10H, the thickness of four wires, and in the case of the coil 10G, the thickness of three wires) with a winding frame (not shown in the figure) of the winding apparatus. As a result, the wires of the winding wire at the winding completion end side are wound in an arrangement state in which they extend in the vertical direction through the entire thickness of the winding frame that is not shown in the figure (state in which the wires are piled up vertically) in portions in which the winding wire at the winding start end side is not crossed and wound in an arrangement state in which they are crushed in the vertical direction and flattened in the transverse direction (state in which they are laid down transversely) since the thickness is controlled by the winding frame (not shown in the figure) correspondingly to the thickness of the winding wire and the winding start end side (thickness of the number of wires arranged in the vertical direction) in portions in which the winding wire at the winding start end side is crossed. An air-core coil in a wound state produced in a crushing mode is then formed by conducting a fusion treatment after the winding is completed and removing from the winding shaft 2.

In FIGS. 5, 7-9, as a preferred mode, it is explained a state in which wires at a winding start end side are piled up vertically in one or two rows and arranged longer in a transverse direction is retained, whereas a winding wire is drawn forth from an inner circumferential side to an outer circumferential side. It is also included to the embodiments of the present invention that a mode in which an arrangement that wires at a winding start end side change in number of rows from one to two or three as well as from three to two or one to the contrary.

Further, it is explained in a case of an winding wire at an winding completion end side that a state in which a whole arrangement is retained, whereas winding stands are wound from an inner circumferential side towards an outer circumferential side. It is also included in the embodiments of the present invention that a mode in which a state of arrangement displaces (changes partially) in some places on the process of winding.

The coil of the above-described air-core type can be advantageously used for contactless power transmission (contact-free power transmission) in electric devices for which the decrease in thickness is essential, for example, cellular phones and portable information terminal devices, but the coil in accordance with the present invention is not limited to the air-core coil and can be also similarly applied to coils wound on a bobbin or core.

Figure 10:
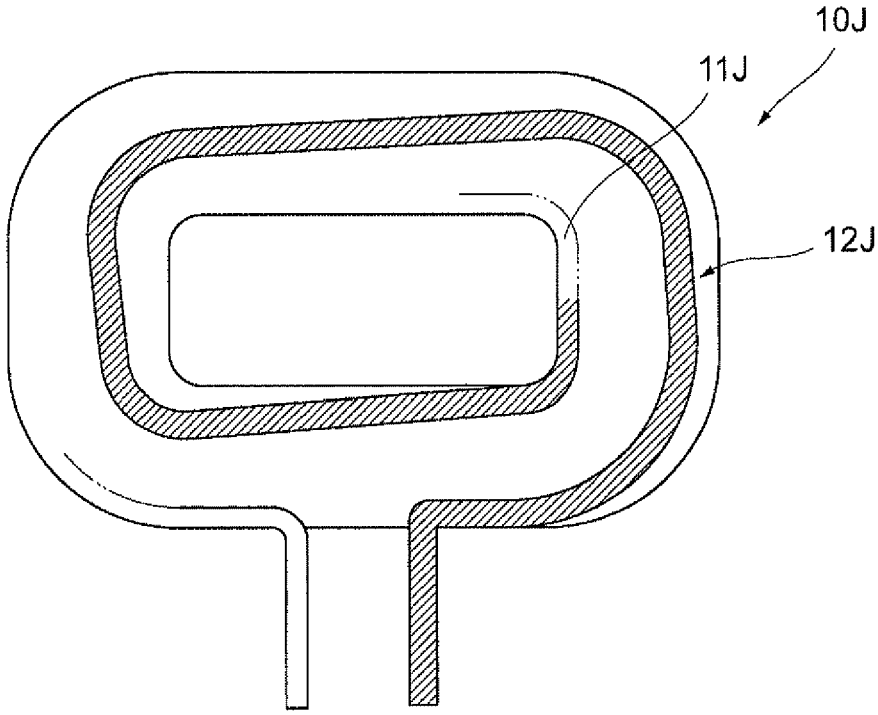
FIG. 10 is a schematic view illustrating a mode in which the outer contour shape of the coil and the shape of each corner of an air-core portion are rounded rectangular shapes in the configuration in accordance with the present invention.
Figure 11:
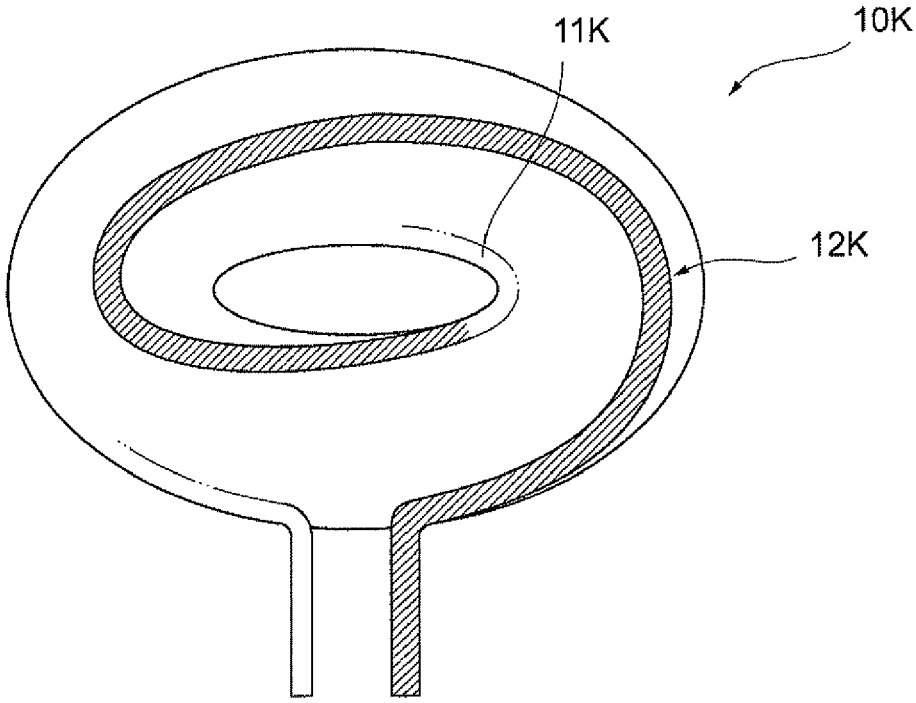
FIG. 11 is a schematic view illustrating a mode in which the outer contour shape of the coil and the shape of an air-core portion are elliptical shapes in the configuration in accordance with the present invention.

Further, in the above-described embodiment the outer contour shape of the coil and the shape of each corner of the air-core portion are both circular, but they can also have a rounded rectangular shape or elliptical shape. In a coil 10J shown in FIG. 10, both the outer contour and each corner of the air-core have a rounded rectangular shape, and in a coil 10K shown in FIG. 11 both the outer contour and the air-core have an elliptical shape.

What is claimed is:

1. A coil comprising:

first ends and second ends of winding wire which are formed by a plurality of wires;

one of the first ends and the second ends of the winding wire is wound from an inner circumferential side toward an outer circumferential side, and an other one of the first ends and the second ends of the winding wire is drawn from the inner circumferential side toward the outer circumferential side, wherein the plurality of wires is wound together in a state of being piled up in a vertical direction when viewed from a bottom surface of the coil to a top surface of the coil, the plurality of wires are superimposed and caused to cross each other in a state in which the plurality of wires are laid down transversely at crossing portions of the first ends of the wires and the second ends of the wires, and a total thickness of the coil in the vertical direction of the crossing portions of the first ends and the second ends of the winding wire is equal to a total thickness of the coil at other portions of the coil other than the crossing portions.

2. The coil according to claim 1, wherein the first ends of the wires are wound from the inner circumferential side toward the outer circumferential side and the second ends of the wires are drawn forth to the outer circumferential side to form a curve, and the crossing portions are arranged to be displaced in a circumferential direction toward the outer circumferential side.

3. The coil according to claim 2, wherein the second ends of the plurality of wires are drawn by winding of an integer number of turns from the inner circumferential side toward the outer circumferential side to form a curve on a coil flat surface and then drawn forth to the outer circumferential side.

4. The coil according to claim 1, wherein the plurality of wires are constituted by self-fusing wires.

5. The coil according to claim 1, wherein the coil is an air-core coil.

6. The coil according to claim 5, wherein an outer contour shape and a shape of each corner of an air-core portion are one of a rounded rectangular shape and an elliptical shape.

7. The coil according to claim 1, wherein the coil is constituted for use in contactless power transmission.

8. The coil according to claim 1, wherein in laying down the plurality of wires transversely, an arrangement state of the plurality of wires is twisted 90° without changing a positional relationship of the plurality of wires.

9. The coil according to claim 1, wherein in laying down the plurality of wires transversely, a positional relationship of the plurality of wires changes so that an arrangement state of the plurality of wires is crushed in the vertical direction to obtain a flat configuration in a transverse direction.

* * * * *